US005847663A

United States Patent [19]

Chasek

[11] Patent Number: 5,847,663

[45] Date of Patent: Dec. 8, 1998

[54] MULTI PURPOSE COMMUNICATIONS SYSTEM FOR INTELLIGENT ROADWAYS BASED ON TIME-COMPANDED, SPOKEN ADVISORIES

[76] Inventor: Norman E. Chasek, 24 Briar Brae Rd., Stamford, Conn. 06903

[21] Appl. No.: 205,554

[22] Filed: Mar. 4, 1994

[51] Int. Cl.[6] ..... G08G 1/09

[52] U.S. Cl. ..... 340/905; 340/93.1; 340/988; 364/436; 364/437; 455/49.1; 455/70

[58] Field of Search ..... 340/905, 988, 340/928, 934; 364/424.01, 436, 437, 423.098, 424.027; 455/49.1, 53.1, 54.1, 70, 72

[56] References Cited

U.S. PATENT DOCUMENTS

| | | | |
|---|---|---|---|
| 4,962,457 | 10/1990 | Chen et al. | 340/905 |
| 5,173,691 | 12/1992 | Sumner | 340/905 |
| 5,214,793 | 5/1993 | Conway et al. | 340/905 |
| 5,289,183 | 2/1994 | Hessett et al. | 340/905 |

*Primary Examiner*—Jeffery Hofsass
*Assistant Examiner*—Edward Lefkowitz

[57] ABSTRACT

Real-time, multi-purpose advisories that inform users of roadways on upcoming situations, require frequent gathering and interpreting of information gleaned from road systems, and then feedingback information by means of repeated, spoken descriptives pertinent to each driver's location and heading. A system that provides all this, plus supports interactive communications between specific vehicles and a control center for purposes of describing roadway incidents, for the dispatch of emergency services; to request aid if stranded; to request destination directions; to receive destination-specific alternate-route advisories; etc., is described by the invention. Communication system simplification, essential to system practicality, is realized by time compressed, digitized spoken messages that flow thru single frequency, unidirectional repeaters, each message representing about 30 seconds of spoken descriptive advisory compressed into less than one second. These packets are dropped off and digitally stored at designated repeater sites for radio transmission of the original spoken message to all, or to specific vehicles in that repeater's vicinity.

19 Claims, 6 Drawing Sheets

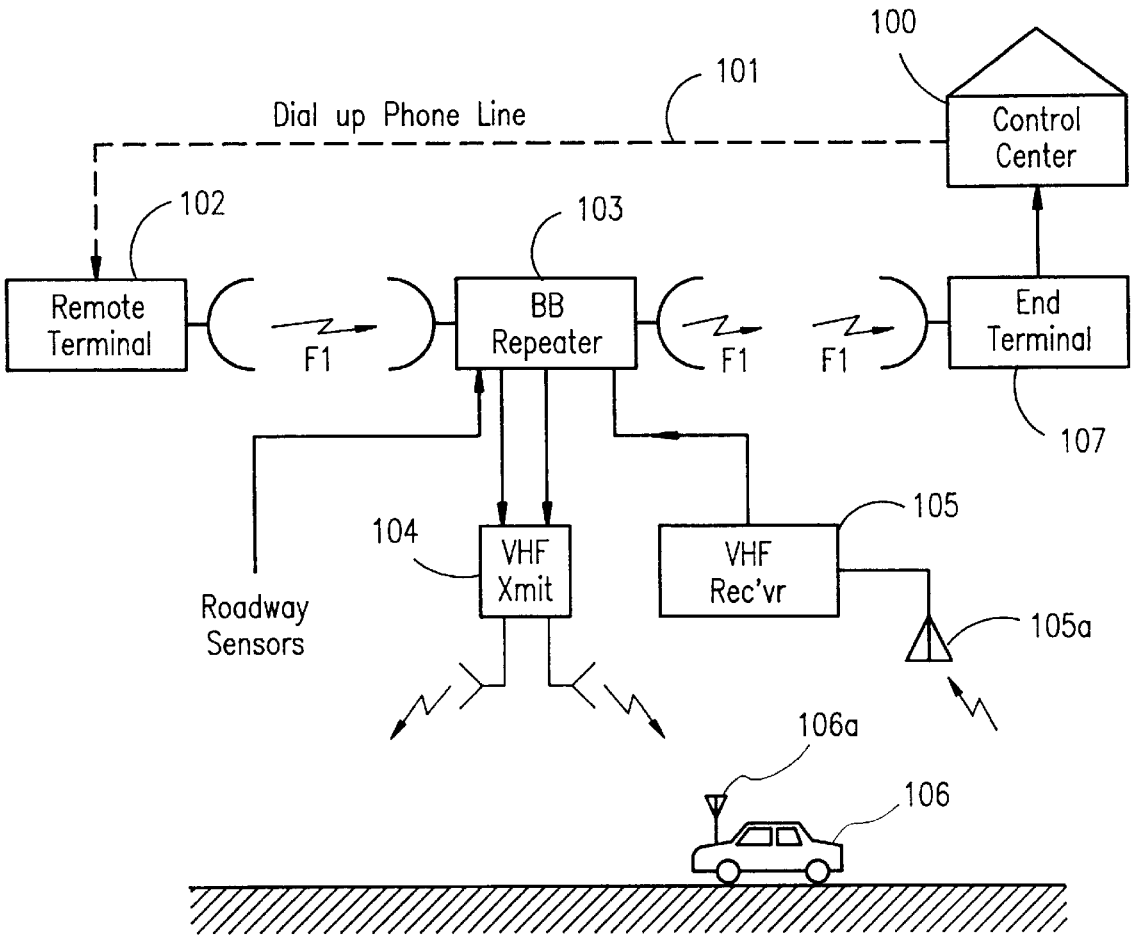
FIG. 1a
FIG. 1b
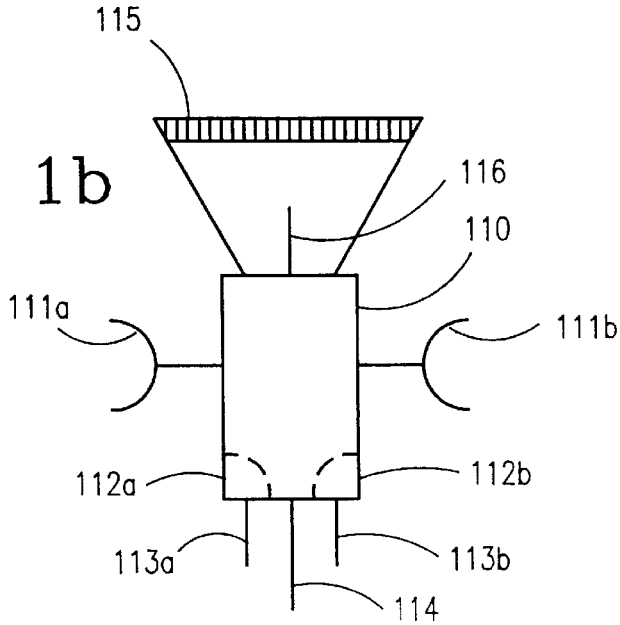

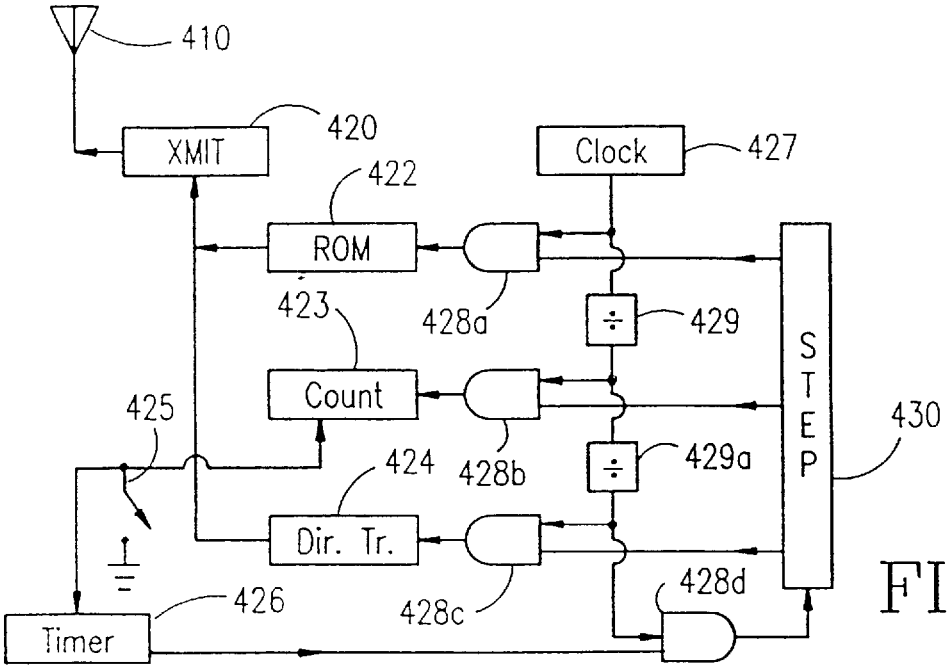
FIG. 5
FIG. 6a
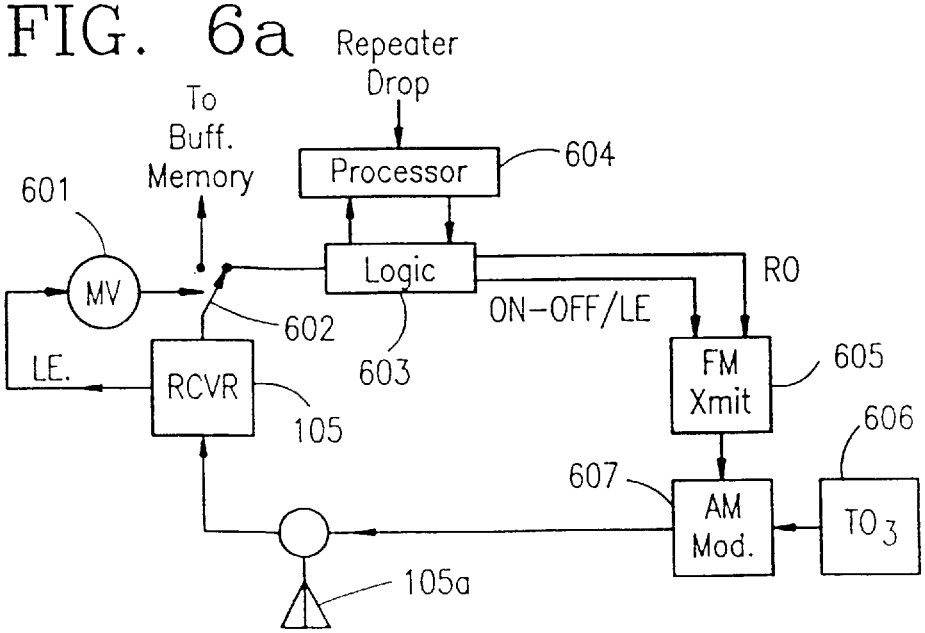

MULTI PURPOSE COMMUNICATIONS SYSTEM FOR INTELLIGENT ROADWAYS BASED ON TIME-COMPANDED, SPOKEN ADVISORIES

BACKGROUND

Intelligent roadways of the future will provide real time, geographically tailored, and individually targeted advisories with interactive capabilities to enhance their usefulness to drivers. The advisories should preferably consist of verbal descriptions with enough information so drivers can make individual judgements about dealing with the traffic conditions ahead. The same system should also generate information needed to quickly localize and characterize roadway incidents to expedite prompt dispatch of appropriate emergency personnel, including rescue of stranded motorists. It should also provide directions to motorists on how to best get to their destination or find services. Present advisories provide too little information, too late or is too widely dispersed.

The apparatus normally needed to support such capabilities is made impractical by its complexity and high cost. The core of this invention lies in its apparatus efficient, companded-time "bucket brigade" mode of communications which performs as a information distributor along highways to support a variety of services aimed at making the road systems more user friendly.

The communications system should include means for picking up roadway information, bringing that information to a control center where explanatory & advisory messages, preferably spoken in less than 30 seconds of duration, are generated, addressed, and dispatched to specified locations where they are passed on by radio to drivers in that vicinity. Vehicle radios should include simple means to interactively feed driver generated information back to a control center.

Covering long distances along highways is generally cheaper by radio, but communications that requires frequent drop and adds are more appropriate to cable or telephone lines. An important aspect of this invention is how a low cost, long, multi purpose microwave communications system with frequent drops and adds is realized.

SUMMARY OF THE INVENTION

This verbal advisory system is comprised of four parts; road sensors, trunk communications, a control center, and vehicle-transceivers. The trunk system provides means for getting information from drivers and roadway sensors to the control center and for getting advisories back from the center to a designated locale where the message can be repeatedly transmitted to motorists in the immediate vicinity through a low power radio transmitter.

The control center absorbs, digests and reacts to the flow of data it receives, creating spoken messages with address codes that are sent via a dialup phone line to the outermost terminus of a "bucket brigade" radio repeater trunk system where each message is digitized and stored in digital memories. The memories are readout at high speed so that a 30 second message is typically compressed in time to occupy less than one second of transmission time. These compressed message packets move downstream, typically through 100 or so repeaters spaced from 1 to 5 miles apart, in a "bucket brigade" fashion in which each packet is received, temporarily stored and then retransmitted onto the next repeater. Each packet moves down the repeater line until it reaches its assigned destination where it is diverted into a spur memory where it is readout into a digital-toanalogue converter at a rate that recreates the original spoken message. The analogue signal is then modulated onto an RF carrier whose frequency is assigned to one of the two roadway directions for reception by passing vehicular radio receivers. That transmitter and the vehicle's receiver preferably include means to automate selection of received frequency that is appropriate to vehicle's heading.

The "bucket brigade" repeater operates as follows: Each repeater's receiver is turned on during reception time interval and is kept on until a full message block has been received and temporarily stored in a digital memory. Then the transmitter is turned on for one message block period while the memory is off loaded, after the receiver is turned off. This makes feasible single frequency operation. It also makes possible self-redundant operation.

Interactive communications, such as reporting a road incident to the control center, is done with a low power vehicular radio transmitter that communicates the vehicle's ID number, VIDN, and a yes/no message-switch condition, to the nearest repeater site, where it is fed into a spur-memory for transmission back to the control center. Each spur memory adds its stored bytes to the end of a data train formed by bytes picked up from preceding repeaters. This data "train" is interdispersed in time with the time compressed, digitized verbal advisory packets.

The advisory packets from the control center can be directed to a specific vehicle thru use of the repeater's address and vehicle's IDN. Another piece of information is direction-of-travel or DOT. This determines which frequency the vehicle's receiver should be tuned to for receipt of DOT-appropriate advisories. Automating DOT tuning is an aspect to this invention.

The availability of VIDN, DOT and repeater address information makes various location-specific, heading-specific, vehicle-specific and destination-specific interactive services possible. For example, automated travel directions can be requested by punching the destination zip code and activity-request code into a keypad and then transmitting the zip code, activity-request code, and DOT to each repeater as it is approached until the repeater/terminal closest to the destination's recommended exit is interogated. This interrogation triggers the appropriate synthesized voice message stored in specific repeaters which instruct the inquiring vehicle to exit.

The various aspects and advantages of this invention will be more fully understood from a consideration of the following detailed description in conjunction with the accompanying drawings, in which:

FIG. 1*a* is a block diagram illustrating major sub system components of the advisory communications loop.

FIG. 1*b* illustrates a possible repeater packaging for pole mounting.

FIG. 2*a* illustrates key segments of the control center.

FIG. 2*b* is a block diagram describing the remote terminus.

FIG. 3*a* is a block diagram of the repeater station including drop and add provisions.

FIG. 4*a* is a block diagram of the repeater-to-vehicle transmitter including part of the automated direction-of-travel determination capability.

FIG. 4*b* is a block diagram of the vehicle's radio receiver with means for self tuning to the correct direction-of-travel frequency and for passing vehicle-specific advisories.

FIG. 5 illustrates means for introducing interactive communications between control center and specific vehicles.

FIG. 6*a* illustrates apparatus added to repeater's drop facility to provide synthesized speech advisories to passing vehicles.

FIG. 6*b* illustrates added apparatus to vehicle's receiver to support destination-directional and repeater originated brief spoken messages.

DETAILED DESCRIPTION OF THE INVENTION

Figure 2A:
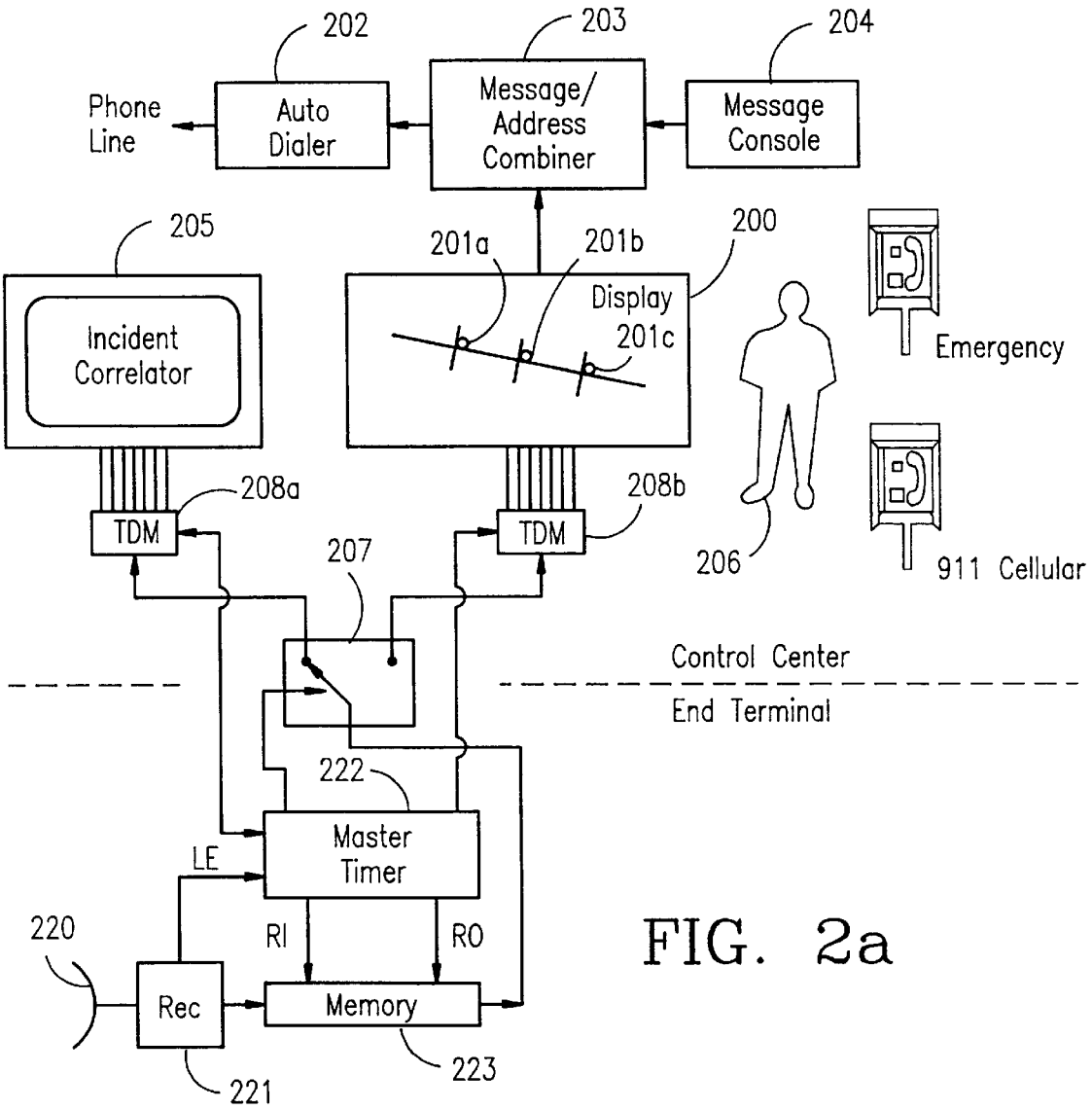

The language and diagrams used to describe some of this invention's specific functions is in terms of hardwire-logic rather than of a software implementation. Hardwire-logic diagrams however can serve as a basis to generate algorithms for a software/microprocesser implementation, if that approach is advantageous.

Referring to the drawings in detail, FIG. 1*a* illustrates the major components of a single loop advisory system. This loop has transmission moving toward the control center. The system includes control center 100, remote terminus 102, dial up telephone line 101, repeater 103 which is typical of n hops ending at end-terminus 107 co-located with control center 100. Each repeater, if microwave implemented, would use the same frequency, unless the loop branches. Single frequency operation is made possible by the "bucket brigade" mode of repeater operation. Single frequency operation greatly simplifies system logistics.

Each repeater station includes means for adding data acquired from roadway sensors and from passing vehicle, 106, via receiver 105, onto a passing data train, and means for dropping off verbal messages for radio transmission to passing vehicle 106 via transmitter 104. The data train builds in its assigned-time slot by adding picked-up data, that is stored locally and then at the appropriate moment, onto the passing data train.

The system described by FIG. 1*a* uses a microwave repeatered trunk, which is the preferred version for highways, rather than a cable or twisted-pair repeatered trunk, which is preferred for local roads. The time companded, "bucket brigade" operation can be used on cable, optical fiber or twisted pair lines. Also the actual road system may be a complex of interconnecting highways and roadways which would require multiple loops which could include branches within a loop.

FIG. 1*b* illustrates a possible physical embodiment of a pole mounted repeater station made practical by this invention. It is comprised of a housing 110, beam forming parabolas 111*a* and 111*b*, doppler radar sensor radomes 112*a* and 112*b* for measuring roadway traffic speed in each direction, VHF directional transmitter antenna feeds 113*a* and 113*b* and reflector 114, omni directional antenna stub 116 used for receiving messages from passing vehicles, and solar panel 115 that powers the repeater.

FIG. 2*a* describes a possible control center which includes roadmap, 200, on which each repeater site is represented by information cell, 201. Each cell might have red, amber, and green lights, with one cell for each direction of travel. The light color illuminated indicates the average traffic speed. The cell also includes a touch sensitive switch which, when touched, readsout that repeater's address which is tagged onto any message directed to that repeater. Automatic dialer 202, when actuated, connects the remote terminus to the control center via phone line. The descriptives and advisories are generated and stored in audio message console 204, tagged with their specified repeater address codes in combiner 203, and the messages are transmitted over the phone line to remote terminus 102 illustrated in more detail by FIG. 2*b*.

The control center directs received data messages from each repeater site to incident-correlater 205 where data it is collected and displayed for interpretation by operator 206. The control center includes end-terminus 107, which consists of directional antenna 220, FM receiver 221, master timer 222, message memory 223, and roadway data and incident data separator switch 207. The two output ports from switch 207 feed into time division data demultiplexing switches 208*a* and 208*b* whose outputs feed data to incident-correlator 205, and control light color of each display cell 201.

The End-Terminus normally receives information from its preceeding repeater via highly directional antenna 220 and receiver 221. The received digital stream is serially read into digital memory 223 with a storage capacity of roughly 2 megabits. The receipt of message block LE, leading edge, time references master timer 222 which controls electronic switch 207 that separates the data fed from memory 223 into two lines, feeding time division demultiplexers 208*a* and 208*b*, which further breaks out into individual buslines that feed the two control center display-processers. After all the data is readout and stored, memory 223 is cleared and is ready to repeat the process with the next message block.

Figure 2B:
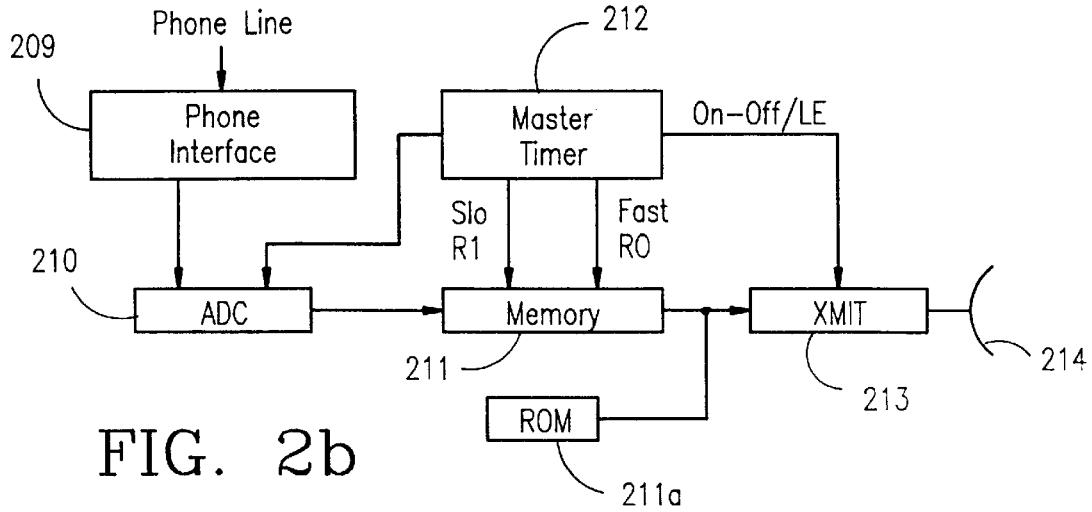

FIG. 2*b* illustrates how the remote-terminal might operate. Spoken messages with address codes are received over the phone line and are fed first into analogue-to-digital converter 210 and then into a bank of switched parallel digital memories, 211, which stores each message, now digitized, then sequentially reading out and clearing each memory at a much faster rate, thereby creating time compressed messages that are transmitted down the repeater line, each message being addressed to one or more drop points. Master timer 212 controls the analogue-to-digital conversion, the memory read-in and readout rates, and provides a leading edge, LE, marker to transmitter 213 which is separated from the message stream and used to indicate the start of a message block. FM transmitter 213 feeds directional antenna 214 which is pointed to the first repeater. The typical message of 30 second duration might be compressed down to a 1 second digital burst. Any subsequent message would be delayed by at least 1 second before being transmitted. Time expansion occurs when the message packet is converted back to analogue at its repeater drop. A new 30 second message could be fed into the repeater-line every 2 seconds.

Figure 3A:
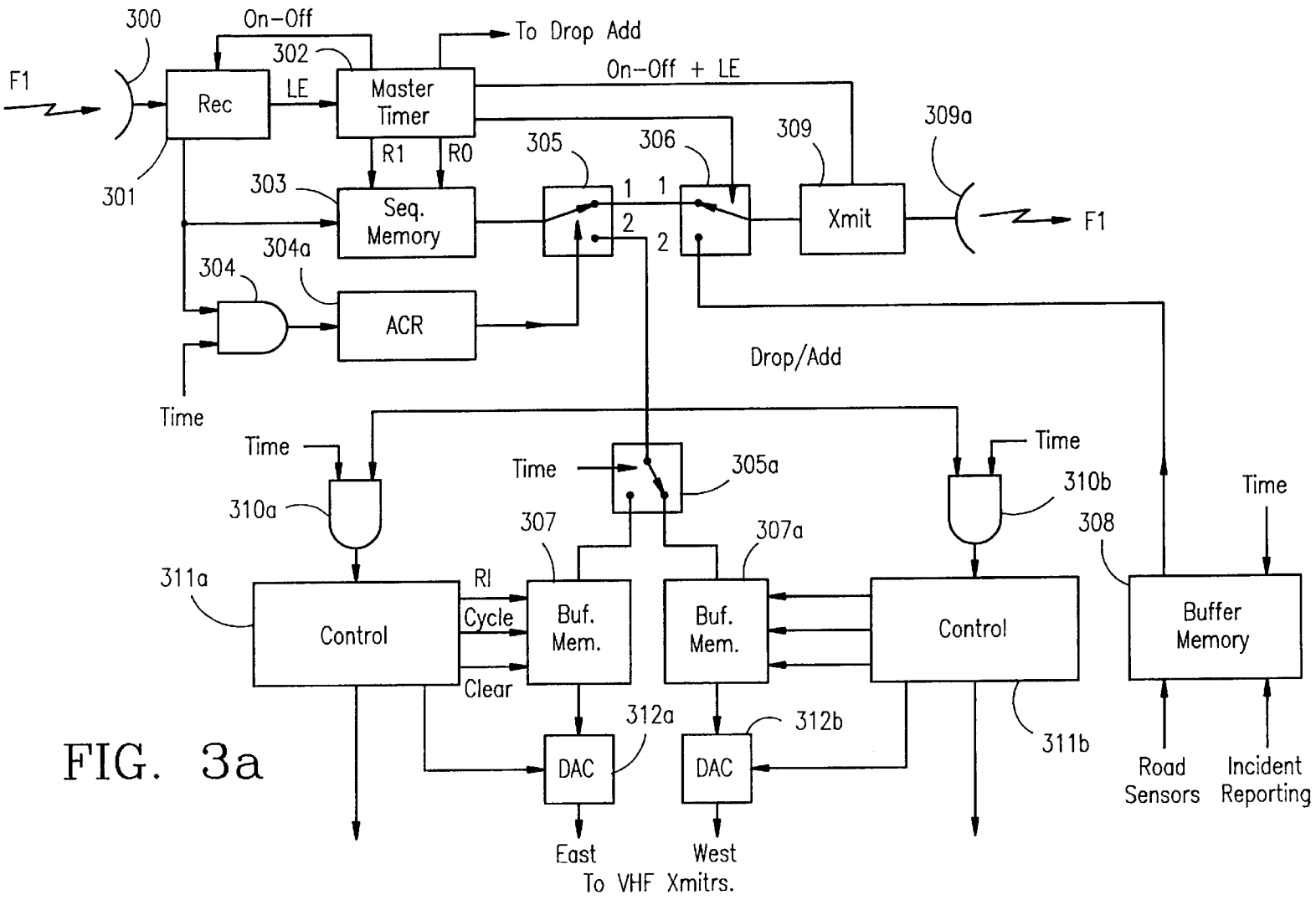

FIG. 3*a* illustrates a preferred repeater configuration. It consists of receiving antenna 300, FM receiver 301, master timer 302, seq-memory 303, address code gate 304, address code detector 304*a*, SPDT electronic switches 305, 305*a* and 306, message drop memories 307 and 307*a*, data-add buffer memory 308, gated FM transmitter 309 and transmitting antenna 309*a*. Squelched FM receiver 301 detects the message block's leading edge, LE, whose presence triggers master timer 302, which controls seq. memory 303 read-in and readout functions as well as the half duplexed turn-on and turnoff sequences of receiver 301 and transmitter 309. Address Code Detector 304*a* detects the presence of a matching address. Presence of the matching address acts to latch switch 305 from position 1 to position 2 for the message time duration causing that message to be dropped into either memory 307 or 307*a* depending on whether it is an EAST or WEST bound message which is determined by switch 305*a* and the time slot which the message occupies. (If there is no address code match the message is passed thru.) Once the message is fully read into memory 307 and/or 307*a*, the message is readout by a slow clock originating in controllers 311*a* and 311*b*. This readout expands the message back to its original time duration. The digital message is then converted to analogue in DAC 312*a* or 312*b* which recreates the original spoken message. Controllers 311*a* and 311*b* also translate instructions separated from the message stream by gates 310*a* and 310*b*. That instruction might be 1) to read-in a new message, or 2) to recycle the stored message, or 3) to clear the memory. (If there is no message present that condition is forwarded to switches 405 and 405*a* shown in FIG. 4*a*.) Switch 305 is unlatched by a signal from timer 302 which is time referenced from the message leading edge, LE, pulse. Transmitter 309 is normally turned off, except when memory 303 is readout, which turns on transmitter 309 and turns off receiver 301 for the message block duration.

Timer 302 activates switch 306 from position 1 to 2 for the data-insertion-time assigned to that repeater. That time is referenced from the leading edge, or LE, marker pulse. During this interval the data stored in buffer memory 308 is readout in time to be added onto the data train accumulated from previous repeaters. Readout completion returns switch 306 to position 1, restoring the through path.

A second implicit function of squelched FM receiver 301 and memory 303 is to automatically bridge over a failed repeater assuming there is enough fade margin to operate on signal overreach originating from the repeater preceeding the failed repeater.

A complete message packet consists of the LE marker, an address code, an instruction code followed by the time compressed, East or West message. The instruction code orders read-in, cycling, or clearing of the stored message. Each time compressed message might be ⅓ of a second in duration. If this represents a 30 second verbal advisory that occupies a 4 kHz band and is encoded by a spectrally efficient delta modulation of 32 Kbps, the time-compressed packet would be transmitted at a 2.88 Mbps rate.

An essential part of the repeater's sub-system is communicating each message stored in message memory 307 to passing vehicles. This communication is realized by low power radio transmissions from the repeater site to vehicle radios in its vicinity. EAST bound traffic would receive messages on one frequency and WEST bound traffic on a second frequency.

Drivers would normally like to have their radio receiver tuned to radio programs when there are no advisories present in memories 307 and 307*a*. They would also not like to make decisions as to what advisory to tune to depending on their direction of travel, or to have to listen to advisories not pertinent to them. Successfully addressing such details, in addition to low cost, is pivotal to broad acceptance of any such system.

Figure 4A:
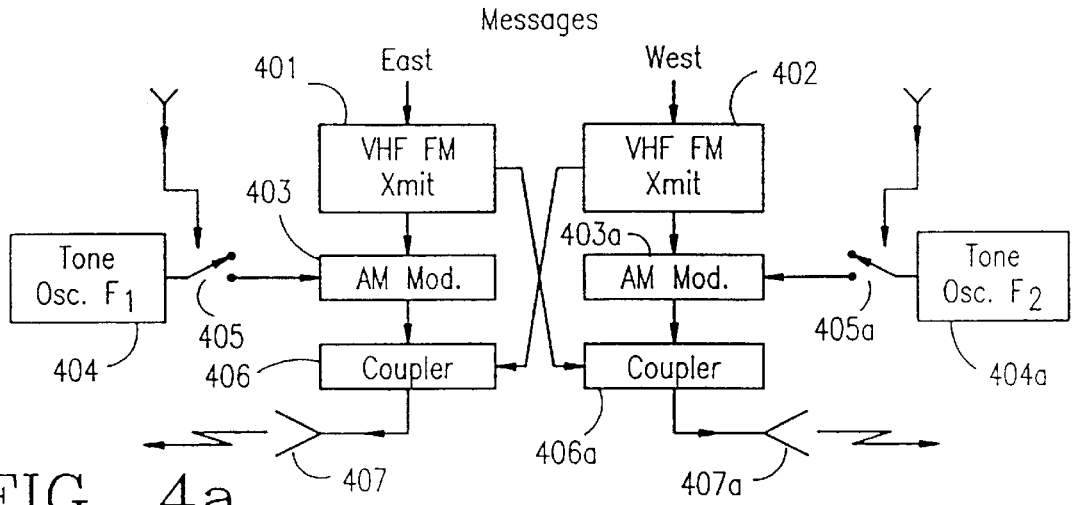
Figure 4B:
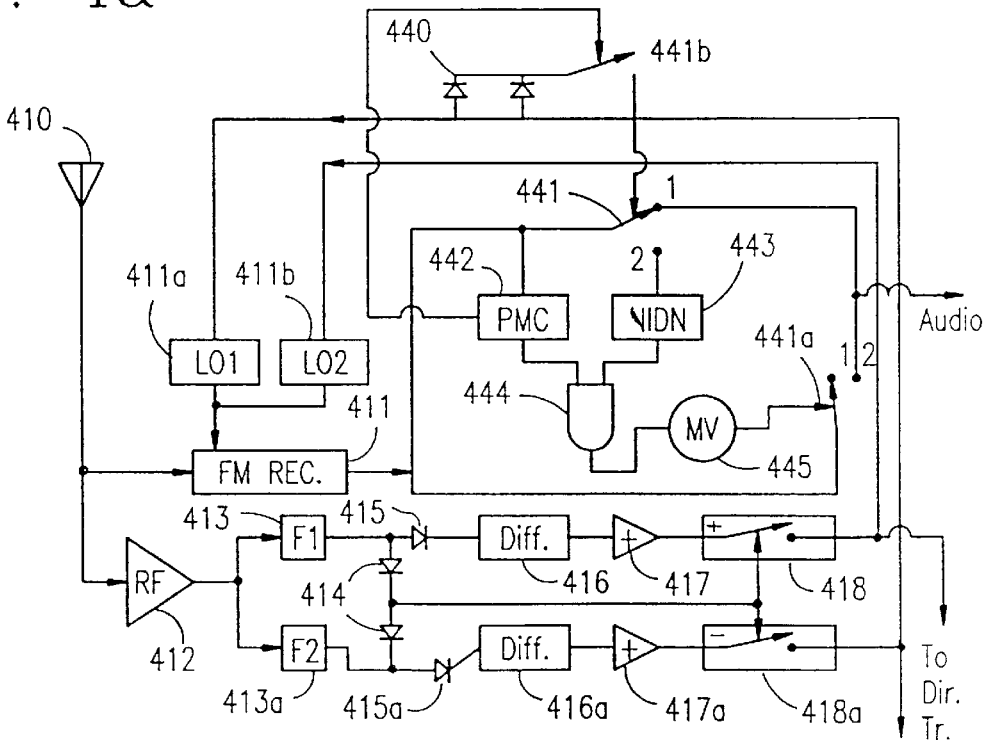

FIG. 4*a* and FIG. 4*b* illustrate a preferred method for automating the direction-of-travel, or DOT, determination and specific-vehicle receiver operation. FIG. 4*a* shows how the repeater site's VHF transmitter would be configured, and FIG. 4*b* shows an adaptation of the vehicle's FM radio. FIG. 4*a* shows East direction advisory messages modulating low power FM transmitter 401 and WEST direction transmitter 402 being modulated by WEST advisories. Each transmitter is followed by low index AM modulators 403 and 403*a* which are separately modulated by tones $f_1$ and $f_2$ provided by tone oscillators 404 and 404*a* applied thru switches 405 and 405*a* which are activated by the presence of message blocks and indicated from controllers 311*a* and 311*b*. When no messages are present, switches 405 and 405*a* are both opened. This causes the receiver shown in FIG. 4*b* to remain in entertainment listening operation. When a message is present, switches 405 and 405*a* are both closed causing the receiver to be tuned to the advisory channel appropriate to its heading.

More specifically the transmitter portion of the automatic DOT tuning operation could be implemented as follows: AM modulators 403 and 403*a* feed couplers 406 and 406*a*, into which are crossfed the non-AM-modulated carriers from transmitters 402 and 401. That combination is then fed to directional antenna 407 (or to antenna 407*a*) one of which is pointed in one direction of vehicle travel and one in the opposite direction.

The standard automobile FM receiver adapted for DOT tuning and specific vehicle selection, shown in FIG. 4*b*, consists of whip antenna 410 feeding FM receiver 411 which is tuned to receive either DOT frequency by electronically activating local oscillator (LO) 411*a* or 411*b*, or to receive entertainment broadcasting by activating the receiver's normal LO. Antenna 410 also feeds parallel RF selective receiver 412 whose output is processed to automatically select the correct DOT local oscillator as follows: The detected output of RF receiver 412 is filtered by piezo electric filters 413 and 413*a* that are fixed tuned to tones $f_1$ and $f_2$. The tone outputs are detected by oppositely poled diodes 414 & 414*a* and similarly poled diodes 415 and 415*a*. The oppositely poled diode output actuates polarity sensitive switches 418 and 418*a*, one of which is closed depending on which detected tone's amplitude prevails over the other. (This voltage can also be used to control FM receiver squelch.) The outputs from similarly poled diodes 415 and 415*a* feed differentiators 416 and 416*a*. If the voltage fed into differentiators 416 or 416*a* increases with time, a positive output signal is produced, and if it decreases, a negative signal is produced. Only the positive signal is amplified in positive unipolar amplifiers 417 or 417*a*, and its output is fed thru either closed switch 418 or 418*a* to the LO bus which logically activates the LO which corresponds to the vehicle's actual direction-of-travel.

The second adaptation shown in FIG. 4*b* allows vehicle-specific communications links with the control center to be introduced. When either LO 411*a* or LO 411*b* is activated, switch 441*b* is also activated causing switch 441 to connect the audio line to VIDN code detector 443. When the received VIDN matches detector 443's assigned VIDN, and that VIDN is followed by a private message code, PMC, which is detected by PMC detector 442, then that VIDN/PMC coincidence activates "and" gate 444 which fires multivibrator 445 for about 30 seconds which holds switch 441*a* so the FM receiver's output has its audio feed connected thru to the speaker's audio amplifier thus effecting a vehicle-specific link between that driver and the control center for that interval of time. For other vehicles in the vicinity, the audio line is blocked during that time interval because the PMC code is present without a VIDN matchup coincidence. Because vehicle-specific messages are dropped only at a specified repeater location, it is possible to assign a reduced number of VIDNs for the vehicle-specific message capability.

When LO 411*a* or 411*b* are not activated, the receiver's normal LO is active, and switch 441 directs the FM receiver's output thru to the audio so a radio listener would have normal entertainment use of the receiver. If the radio is not in use, it would automatically be turned on for advisories by the activation of either LO 411*a* or 411*b*. When there is no PMC/VIDN word present, the activation of either LO 411*a* or LO 411*b* by DOT tones also positions switch 441 to allow a thru-audio connection for unrestricted advisories.

FIG. 5 illustrates a low power vehicular transmitter that initiates interactive communications links as follows: FM transmitter 420 shares antenna 410 and is modulated by a message that includes the vehicle's IDN or VIDN, which is burned into ROM 422 during manufacture. A second portion of the message is created by counter 423 which stores the number of push button 425 closures counted during a given time interval. The correct number of push button response is assisted by control center coaching. A third portion of the message is the direction-of-travel code determined from DOT bus shown in FIG. 4*b*. This three word message is transmitted in a few milliseconds, the sequence being triggered by pressing button 425 once following the response read-in closures, the delay being determined by timer 426. The three word burst is clocked out by clock 427 in conjunction with gates 428*a*, 428*b*, 428*c*, divider 429 and 429*a*, and step counter 430.

An illustrative interactive communications scenario for assisting a stranded driver would start with the driver pressing button 425. This causes the transmission of a VIDN/DOT message which is followed by a spoken instructional message originating from the control center. The spoken message is directed to that specific vehicle by first addressing the repeater that picked up the original message followed by the DOT/VIDN/PMC word. The control center's spoken message instructs the driver how many times to press button 425 to characterize a situation. This is followed by the appropriate driver's push button response, followed by the burst release of the VIDN/DOT/Count message.

Another illustrative scenario to be described is for the prompt dispatch of appropriate emergency vehicles. This would have the control center sending an unrestricted inquiry message to repeaters in the vicinity of the incident, typically detected by road sensors, that inquiry solicits observations from passing drivers. Responding drivers press button 425 which releases VIDN/DOT for transmittal down the repeater chain to the control center. The control center uses that information to respond with its VIDN/DOT/PMC to either establish a cellular phone link or to proceed with coached interactive communications that characterize the incident.

Figure 6B:
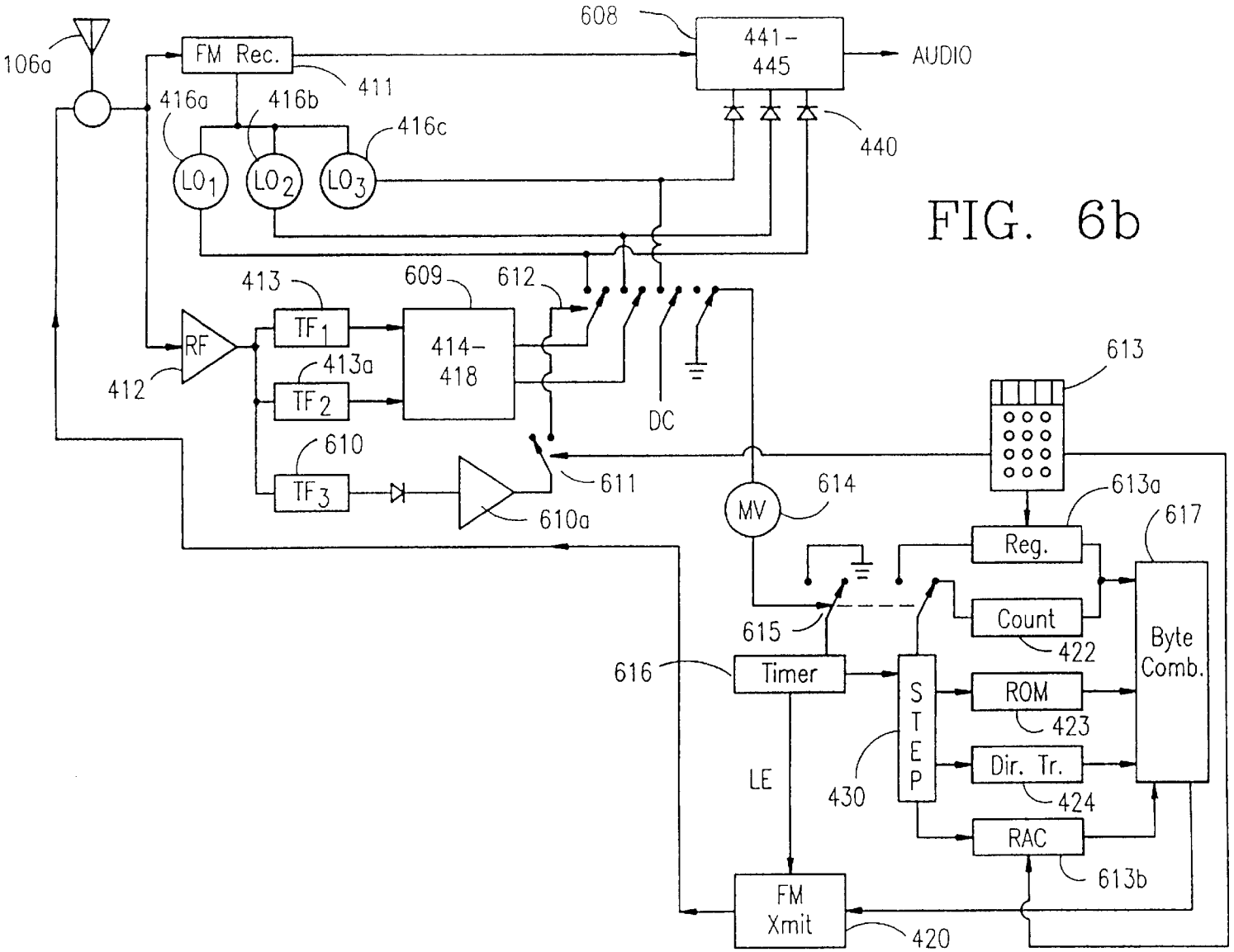

Push button 425 can also incorporate a rotary switch/volume control which keeps the advisory function activated if the radio's entertainment function is switched off and also adjusts the advisory audio level independently of the set entertainment audio level. FIGS. 6*a* and 6*b* illustrate how with further modification of the repeater terminal (FIG. 6*a*) and the vehicle's radio (FIG. 6*b*), it is possible to introduce innumerable other services such as destination directions, exit ramp directions, destination-specific alternate route advisories, etc. For example, in a destination direction advisory service, keypad 613, shown in FIG. 6*b*, is added and used to punch in the destination's zip code with an activity-request-code. The punched in information is then transferred to register 613*a*. The keypad 613 punch-in latches switch 611 closed. This closure causes any detected output from tone filter 610 to move four-ganged-switch 612 to position 2. Meanwhile the very low power FM transmitter 605, shown in FIG. 6*a*, added to the repeater site is always on with a low index amplitude modulation introduced by tone generator 606 feeding amplitude modulator 607. When the frequency of Tone Generator 606 is detected at the output of RF amplifier 412 by tone filter 610 and amplifier 610*a*, four-ganged-switch 612 activates to turn off LO 416*a* or LO 416*b* and to turn on LO 616*c* so receiver 411 will now receive the digital message from FM transmitter 605 originating from processer 604. Processer 604 stores synthesized, brief verbal messages that are frequently used to indicate a turn-off.

The switching of switch 612 also fires multivibrator 614. This moves switch 615 to position 2 releasing the zip code stored in register 613a, the VIDN/DOT stored in memory elements 423 and 424, the requested-activity-code (RAC) stored in element 613*b*, and the leading edge marker from timer 616. All this is readout by step counter 430 and combined in combiner 617 for transmission by FM transmitter 420. This combined message is received in vehicular receiver 105 (see FIG. 6*a*) where the leading edge, LE, signal activates switch 602 through monostable multivibrator 601. This diverts any subsequently received message into logic array 603 instead of to a buffer memory from where it would be forwarded to the control center. Logic array 603 operates in combination with processer 604. Processer 604 stores several brief synthesized voice messages which would be either selected by an appropriate interrogation from passing vehicles, or called up by the control center to respond to subsequent vehicular interrogations, or be repetitively transmitted. For example, an automated destination-direction interactive operation would have the zip code, the direction-of-travel code with approriate RAC fed into processer 604 with the VIDN/PMC prefix stripped and temporarily stored in logic array 603. Logic array 603 steps the received zip code through comparisons with a stored list of zip codes pertinent to the upcoming exit or turnoff. A zip match and the DOT act to select one of two or three spoken instructions stored in processer 604. The spoken message is then preambled by the temporarily stored PMC/VIDN. The composite message is fed to transmitter 605 whose limited power allows only vehicles within a thousand feet or so to receive the message and only that vehicle with the matching VIDN to hear the direction-giving message.

Detailed travel directions could be requested by punching in the appropriate request code followed by the destination's zip code onto which is tagged the direction-of-travel and VIDN. This message is sent to the control center where personnel generates a verbal, direction-giving message from zip/DOT and repeater location information, preambling the direction giving spoken message with the point-of-origination repeater's address plus PMC/VIDN. This is sent back through the communication loop. Completion of the response clears the keypad register.

Destination-tailored alternate route advisories can be actuated by drivers punching in a restricted-message code (RMC) and then the destination zip code. (RMC replaces PMC and zip/DOT replaces VIDN in the PMC/VIDN logic circuitry described in FIG. 4*b*.) Control center personnel generate an alternate routing turnoff-advisory agenda specific to several digits of the zip code destinations. The control center agenda picks the appropriate turnoff message for each specific repeater. The appropriate synthesized voice messages are setup so only vehicles with matching zip/DOTs will trigger and hear that destination-specific alternate route synthesized voice turn-off advisory.

I claim:

1. In a multi purpose road/vehicle communications system, a relatively low cost method for collecting data, for distributing real-time location & heading-specific spoken descriptive advisories related to roadway conditions, and for supporting interactive vehicle-specific and/or destination-specific advisories, is comprised of the following steps:

inputting roadway data received from many road sensors and passing vehicles to a control center where spoken advisory and/or descriptive messages are created and addressed;

sending said addressed spoken messages to the road's remote-terminal;

converting said messages into time-compressed digital message bursts;

feeding said compressed message bursts sequentially into a single transmission medium served by a unidirectional repeater chain with repeaters typically spaced 2 miles apart;

dropping each message burst at its addressed repeater site where said message is digitally stored in a memory device that is continuously readout until cleared on instruction from said control center;

time-expanding said digital message readout, converting said message to its original analogue form; and modulating a low power radio transmitter with said analogue message for reception by appropriately tuned vehicular radio receivers passing in the vicinity of said repeater site.

2. The method of claim 1 wherein said repeaters are implemented by a microwave "bucket-brigade" half-duplexed process that allows single frequency operation, comprising the steps of:

turning on said repeater's receiver to receive said message burst with its transmitter turned-off;

feeding said received message burst into a digital memory where it is briefly stored;

detecting an end-of-message indication which turnsoff said receiver and turns on said repeater's transmitter; and reading out said memory contents into said repeater's transmitter, which transmits on the same frequency that said repeater's receiver is set to receive.

3. The method of claim 2 wherein said microwave repeater system self-bridges a failed repeater providing fail-soft operation of the repeater system.

4. The method of claim 1 wherein said radio means that transmits said dropped message from the repeater site to passing vehicles using two radio frequencies, one for communicating with vehicles traveling in one direction and the other for the opposite travel direction.

5. The method of claim 1 wherein picked-up roadway data is inserted in a time slot assigned to said repeater permitting repeater site originating said data to be identified at control center.

6. The method of claim 1 wherein a capability for communicating with a specific vehicle on the roadway is implemented by the further steps of:

receiving VIDN (vehicle identification number originating from a vehicle) at said control center, where the VIDN originating repeater is determined;

addressing response message and inserting private message code (PMC) prefix followed by said VIDN; and vehicles receiving said responding message with only said PMC prefix act to block receiver's audio, but if PMC is followed by a vehicle identity-matching VIDN, said audio is unblocked and message is heard only in that vehicle.

7. The method of claim 1 wherein an interactive communications link is established between a vehicle wishing to initiate such communications with the control center, as would be the case for a stranded vehicle seeking assistance, is comprised of the further steps of:

driver pressing an initiating button which burst-transmits a VIDN digital word identifying the vehicle;

receiving and storing said VIDN word in nearest repeater's data memory;

reading out said VIDN word into said repeater's assigned pickup time slot where it is carried to said control center and finally registered in display console where vehicular location is interpolated;

addressing verbal response created at said control center and inserting said PMC/VIDN prefix; and proceeding with interactive communication where vehicle operater responds to control center verbal inquiries and coaching with VIDN prefixed yes or no bytes articulated and burst-transmitted by push button.

8. The method of claim 1 wherein an interactive communications link is initiated by control center between anyone of many possible vehicles and said control center, as would be the case when a control center is seeking information describing an emergency situation from vehicles in its vicinity, is comprised of the further steps of;

detecting and localizing an irregular roadway condition from road sensor data displayed at control center;

addressing control center's verbal inquiry to all vehicles in the vicinity of a repeater, or repeaters, nearest to said roadway condition until a responding VIDN, or VIDNS, is received; and prefixing control center response with PMC and selected vehicle's VIDN, said control center's inquiries posing questions that can be answered by coached push button responses from which control center determines nature of the incident, or can use interactivity to setup a cellular phone conversation between control center and a designated vehicle.

9. The method of claim 1 wherein said vehicle receiver automatically determines vehicle's direction-of-travel, DOT, by a method comprising the further steps of;

splitting each of said repeater's DOT-assigned radio carriers to feed two directional antennas, each pointing in opposite roadway directions, with both carriers being combined after a different, low index tone modulation has been applied to each carrier; and determining in vehicle's receiver which tone is both largest and increasing in amplitude with time, which by inherent logic determines DOT of said vehicle.

10. The method of claim 1 further used for destination-direction giving instructions, is comprised of the further steps of:

driver registering destination zip code in keypad connected to vehicle's transmitter;

driver activating radio transmission of a digital-message-burst consisting of said zip code, a requested-activity code, the DOT code, and VIDN;

receiving said message burst by nearby repeater's radio receiver, or receivers, said message is then entered into repeater's data memory, said memory being readout in its assigned time slot and carried by said repeater chain to said control center where said message is inputted to a control center display console;

composing and addressing destination-direction instruction at said control center; and sending said spoken instruction to appropriate repeater site where it is dropped and transmitted with PMC/VIDN prefix by low powered radio transmitter so said instruction is heard only in that vehicle's receiver with matching stored VIDN.

11. The method of claim 1 wherein destination-specific alternate route advisories are communicated is comprised of the further steps of;

driver entering destination zip code in a keypad;

control center inserting destination-specific alternate route spoken advisories addressed to appropriate repeater sites with restricted message code (RMC) and zip/DOT prefix; and vehicular receiver's detecting only the RMC prefix have audio blocked, whereas receivers detecting an RMC with a matching zip/DOT act to unblock the audio.

12. The method of claim 1 wherein said vehicle radio receiver shares entertainment function with advisory functions, is comprised of further steps of;

detecting, in a parallel receiver channel, presence of modulation used for DOT determination, said modulation being activated only when messages are stored in said repeater's drop memory; and using presence of said modulation to interupt reception of entertainment signals by switching receiver's local oscillator frequency from entertainment frequencies to the DOT assigned frequency.

13. A multi purpose advisory communications system for intelligent roadways is comprised of:

control center with means for composing and addressing spoken messages, typically 30 seconds in duration, and means for displaying picked-up roadway data;

remote terminii, located at the extremity of each monitored road, with means for receiving and converting said analogue messages into time compressed, digital bursts and for communicating said digital message bursts to a first, unidirectional repeater;

plurality of unidirectional repeaters, located at points along roadways, each with means to receive and retransmit signals emanating from said terminus and for dropping and storing appropriately addressed message bursts, and for adding picked-up roadway data into said message stream in designated time slots;

plurality of low power radio transmitter pairs located at each said repeater site with each said pair's input connected to repeater's appropriate dropline, each radio transmitter operating on one of two assigned DOT frequencies onto which is modulated that direction's analogue spoken message;

plurality of vehicular radio receivers with means to process said radio signals received from repeater sites so drivers hear spoken messages pertinent to their roadway location, to their direction-of-travel, and sometimes to their specific vehicle or their destination;

plurality of low power vehicular radio transmitters with means for driver to initiate a digital burst transmission to nearest repeater site; and near-end terminus with means for receiving and organizing roadway data received from said repeater chain, and means for interfacing said data to control center processing and display apparatus.

14. System in accordance with claim 13 wherein said repeater's message-drop subsystem is further comprised of:

means for identifying and dropping a correctly addressed message into one of two digital drop memories, depending on DOT prefix;

means to repeatedly readout said memories until directed by said control center to clear the memory;

means for time expanding stored message to its original time duration by an appropriately slowed readout clock; and means for converting said digital readout to its original analogue message and for directing said analogue message to its DOT designated low power radio transmitter, said transmitted signal being received in passing vehicle receivers tuned to appropriate DOT frequency.

15. Multi purpose communications system in accordance with claim 13 wherein each repeater is comprised of:

unidirectional gated microwave receiver, digital memory, gated microwave transmitter and a timer/detector to control half-duplex operational sequence of repeater so said receiver and transmitter can use the same microwave frequency;

two low power radio transmitters for transmitting dropped messages in analogue form to vehicles, one frequency assigned to each DOT;

two directional radio antennas pointing in opposite directions;

means for superimposing modulation of two different tone frequencies onto said radio transmitters and means for feeding both radio transmitters into said directional antennas to allow vehicle receivers to automatically select the correct DOT radio frequency appropriate to its heading;

radio receiver means to receive digital data bursts transmitted from passing vehicles;

means for combining and storing said received bursts with data bytes picked up from road sensors; and means to readout said roadway data into assigned time slots for transmission to said control center via repeater chain.

16. For a multi purpose communications system in accordance with claim 13 wherein said vehicular radio receiver is comprised of:

whip antenna, electronic controlled tuner, and side RF channel that detects DOT tone modulations causing said receiver to be automatically tuned to one of the two assigned DOT frequencies, depending on vehicle's direction-of-travel; and means for blocking said receiver's audio channel from passing PMC-prefixed messages unless message is also prefixed with a VIDN that matches VIDN permanently assigned to said vehicle, while allowing unrestricted audio access to any message without either PMC/VIDN or PMC prefix.

17. Apparatus in accordance with claim 16 wherein said vehicle receiver automatically switches tuner between its entertainment and advisory frequencies depending on presence or nonpresence of said DOT tone modulation.

18. Apparatus in accordance with claim 13 wherein said vehicle's receiver includes logic and keypad to effect various vehicle-specifying and/or destination-specifying interactive communications sequences.

19. Apparatus in accordance with claim 13 wherein said control center, repeater site, and vehicle transmitter/receiver include means to appropriately select brief synthesized spoken instructional messages which are stored at selected repeater sites and activated by a combination of a specific control center agenda and/or by vehicle originated interrogation codes automatically triggered by proximity to the repeater site's very low powered transmitter.

* * * * *